US006044871A

United States Patent [19]

Zenoni

[11] Patent Number: 6,044,871

[45] Date of Patent: Apr. 4, 2000

[54] OPTICAL FEELER FOR MONITORING A RESERVE OF THREAD IN WEFT FEEDERS AND WEFT FEEDER COMPRISING SAID FEELER

[75] Inventor: Pietro Zenoni, Leffe, Italy

[73] Assignee: L.G.L. Electronics S.p.A., Gandino, Italy

[21] Appl. No.: 09/047,513

[22] Filed: Mar. 25, 1998

[30] Foreign Application Priority Data

Apr. 24, 1997 [IT] Italy ..... TO97A0351

[51] Int. Cl.[7] ..... B65H 51/22; D03D 47/36; D04B 15/48

[52] U.S. Cl. ..... 139/452; 242/364.8

[58] Field of Search ..... 66/132 R; 139/452; 242/364.8

[56] References Cited

U.S. PATENT DOCUMENTS

| | | | |
|---|---|---|---|
| 4,715,411 | 12/1987 | Van Bogaert et al. | 139/452 |
| 4,852,617 | 8/1989 | Hamer et al. | 139/452 |
| 4,865,085 | 9/1989 | Ghiardo | 139/452 |
| 4,936,356 | 6/1990 | Ghiardo | 139/452 |
| 5,765,399 | 6/1998 | Huss et al. | 139/452 |
| 5,894,744 | 4/1999 | Faschitz | 139/452 |

*Primary Examiner*—Andy Falik

*Attorney, Agent, or Firm*—Guido Modiano; Albert Josif; Daniel O'Byrne

[57] ABSTRACT

A feeler for monitoring a thread reserve in weft feeders, comprising a light-emitting device constituted by a light source which directs light rays onto a thread wound in spaced turns on the drum of the feeder, and a receiver which collects the light rays and converts them into electrical signals that indicate the presence or absence of turns of thread. A first focused optical transmission system forms a first pointlike luminous image of the light source on the turn being monitored and, in the absence of the turn, a second pointlike luminous image of the light source located on a screen surface which is arranged below the turns. A second focused optical projection system selectively projects the first or second luminous image, along respective differentiated optical paths, onto at least one optical sensor which emits discriminated signals that correspond to the length of the corresponding optical paths.

16 Claims, 2 Drawing Sheets

OPTICAL FEELER FOR MONITORING A RESERVE OF THREAD IN WEFT FEEDERS AND WEFT FEEDER COMPRISING SAID FEELER

BACKGROUND OF THE INVENTION

The present invention relates to an optical feeler for monitoring the reserve of thread in devices for feeding weft to looms and textile machines in general, and to the weft feeder that includes such device.

More particularly, the present invention relates to conventional weft feeders comprising a fixed drum on which a windmilling arm, actuated by an electric motor, winds a plurality of spaced turns of thread which constitute a weft reserve, wherein the turns of the reserve are unwound from the drum in a preset amount at each beat of the loom and wherein optical feeler means are provided and are suitable to start and stop the motor that actuates the windmilling arm when the weft reserve drops below a preset number of turns and respectively when the reserve is fully replenished or if the thread breaks.

Conventional optical devices for monitoring and detecting the presence of the turns of reserve thread are based on the use of one or more light-emitting devices which direct the light rays onto the thread wound on the drum and of one or more receivers which collect the rays and convert them into electric signals used to indicate the presence or absence of the spaced turns of thread. In the disclosure, the expression "light rays" refers both to rays within the visible-light spectrum and rays within the invisible-light spectrum, for example infrared rays.

In particular, prior European patent No. 624.674 discloses a conventional device for monitoring the weft reserve and the breakage of the weft thread in weft feeders, which comprises an emitter diode and a receiving phototransistor which are arranged at the same upper face of a transparent plate which lies on the drum of the weft feeder and receives the turns of the weft reserve. The emitter sends onto the transparent plate a beam of rays which is inclined by a preset angle of incidence and the receiver receives a beam of rays which emerge from the transparent plate and are inclined by an angle of reflection which is different from the angle of incidence and is produced by multiple-reflection means arranged on the other lower face of the transparent plate. The incident and emerging rays are affected by a turn of the thread reserve when the turn reaches the plate, so as to block out the receiver, which emits a corresponding electrical signal indicating the presence of turns.

Prior European patent No. 327.973 discloses a device for monitoring the weft reserve which is based on the use of a pair of photoelectric cells which send respective rays of light, concentrated by lenses, onto a reflective surface of the drum on which the turns of the reserve are wound. The cells generate electrical signals which are produced by the reflection of said rays. The electrical signals have different durations depending on whether the turns of thread that intersect the incident and/or reflected light rays unwind from the drum by being requested by the loom or advance along the drum by being wound by the windmilling arm in order to form the weft reserve. An electronic circuit, connected to the photoelectric cells, is provided in order to discriminate the signals produced by the advancement of the turns that form the reserve from the signals produced by the unwinding of the turns that leave the drum by being requested by the loom, so that the signals are correctly used to control the actuation motor.

It is also known to perform the optical detection of the presence of the turns of thread of the weft reserve by detecting, by means of a photosensor suitable to provide a useful electrical signal, the light rays reflected by the thread and emitted by a light source which is constituted by a photodiode or the like.

Another known method, disclosed for example in prior Application WO 91/18818, uses an array of sensors, for example optical sensors, arranged on the drum at respective turns of the reserve and suitable to provide signals which are processed by electronic circuits in order to provide various information, including information regarding the presence or absence of the turns of thread.

The above-mentioned conventional monitoring systems entail some drawbacks which limit their use and diffusion. Generally speaking, the systems in fact are all relatively complicated and expensive, and those based on optical reflection entail the drawback that their functional characteristics change over time, due both to the accumulation of dust, lint and the like and to the possible variation of the reflection coefficients of the reflective surfaces, caused by wear and/or microstructural alteration of the materials.

All the above-mentioned conventional systems further have, to varying extents, a sensitivity to ambient light which can bias the monitoring signals and thus requires the use of sophisticated electronic circuits for processing such signals.

SUMMARY OF THE INVENTION

The aim of the present invention, is substantially to eliminate the above-mentioned drawbacks, and within the scope of this general aim the invention has the following important particular objects:

- to provide an improved optical feeler having an extremely simplified structure and capable of supplying a direct and discriminated signal indicating the presence or absence of the turns of thread of the weft reserve;
- to provide an improved optical feeler having a very compact structure and which can be easily associated with the weft feeder, particularly without requiring significant variations in the geometric profile of the drum of the devices;
- to provide an improved optical feeler comprising standard components and not requiring complicated circuits for processing the emitted signal, highly sensitive and substantially immune from changes in the signal produced by wear, presence of dust and lack of maintenance in general.

According to the present invention, this aim, these important objects and others which will become apparent from the detailed description that follows are achieved with an optical feeler having the specific features as set forth in the appended claims.

Substantially, the present invention is based, in order to achieve said aim and objects, on the concept of training, onto at least one turn of the thread to be monitored, a beam of rays emitted by a light source and focused by a first optical transmission signal, which forms a first pointlike image of the light source located on said turn of thread and, in the absence thereof, a second pointlike image which is arranged on a screen surface located below the turn and sufficiently spaced, in a radial direction, from the cylindrical surface for the winding of said turn. Said first and second pointlike luminous images are projected selectively, by means of a second focused optical projection system, onto one or more optical sensors located on corresponding and discriminated optical paths which separate said images from the sensor or sensors; the length of said optical paths is different and depends on the position of the planes on which said first and second images are formed and therefore on the presence or absence of the turns of thread being monitored.

Correspondingly, and according to a more general concept of the invention, one sensor is located along a first optical path which connects the first pointlike image of the light source, formed on the turn of thread, to said sensor and provides a corresponding useful turn presence signal. Another optical sensor is arranged along a second optical path which connects the second pointlike image to said sensor and instead provides a corresponding turn absence signal.

According to a preferred embodiment of the invention, the first and second sensors are unified in a single photodiode with two outputs, of the PSD type, which is capable of generating corresponding and discriminated output signals in terms of current which are proportional to the positions in which the first and second pointlike images of the light source are projected onto the active surface of the photodiode and are therefore proportional to the length of the optical paths that separate the pointlike images from the photodiode.

BRIEF DESCRIPTION OF THE DRAWINGS

Further characteristics and advantages of the improved optical feeler according to the present invention will become apparent from the following detailed description and with reference to the accompanying drawings, provided merely by way of non-limitative example and wherein.

DESCRIPTION OF THE PREFERRED EMBODIMENTS

Figure 1:
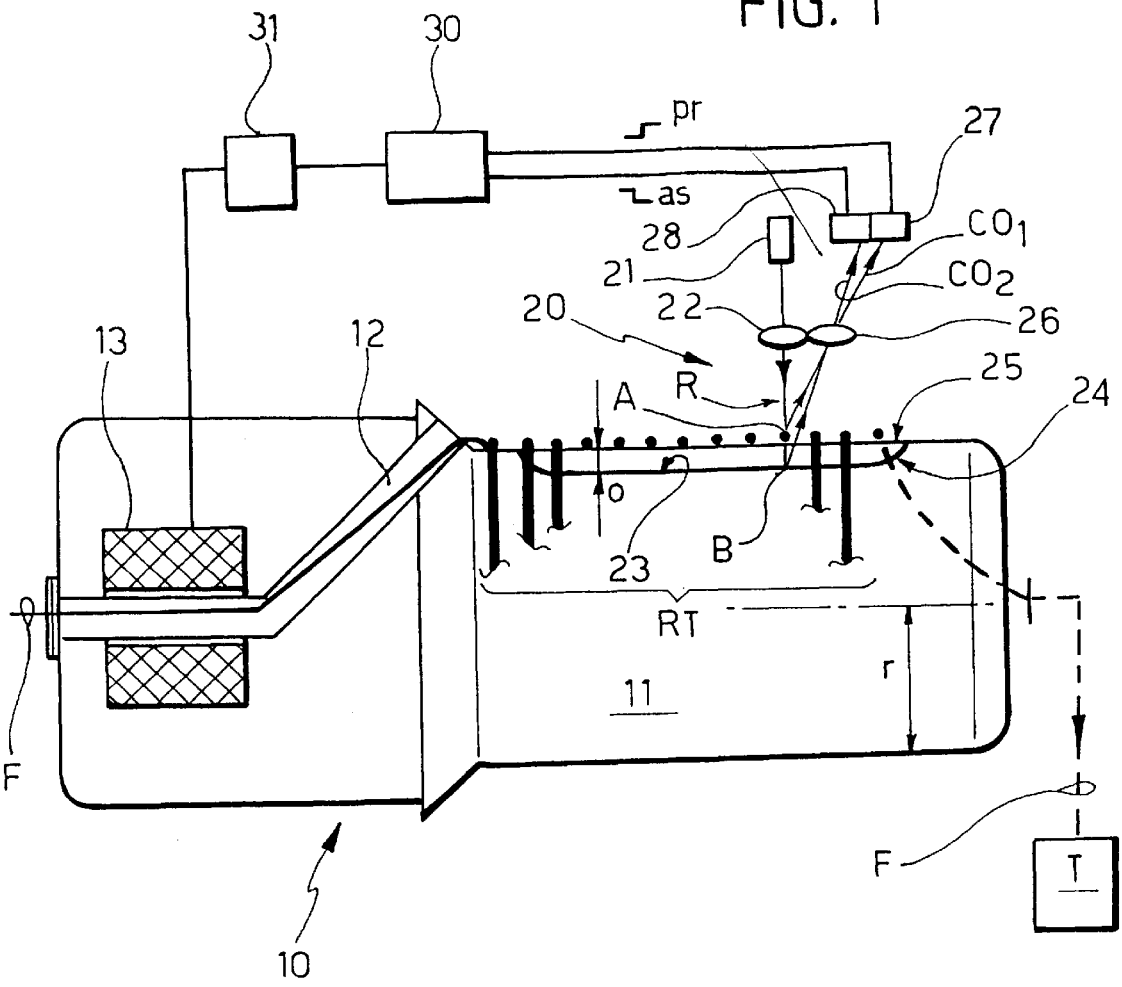
FIG. 1 is a schematic view of a weft feeder with the improved optical feeler according to the present invention.

In the drawings, the reference numeral 10 generally designates a conventional weft feeder comprising a fixed drum 11 on which a windmilling rotating arm 12, actuated by an electric motor 13, winds a plurality of turns of thread F which constitute a weft reserve RT for a loom T or another textile machine. In a per se known manner, the turns of thread F of the weft reserve RT unwind from the drum 11 at each beat of the loom T and an optical feeler 20 monitors the weft reserve, starting the motor 13 of the windmilling arm 12 when the reserve drops below a preset number of turns and stopping the motor 13 when the reserve is fully replenished.

According to the invention, and in order to achieve the specified aim and objects, the feeler 20 comprises a light source 21, constituted by a diode which emits visible or invisible (for example infrared) rays, or by a laser emitter or other high-intensity light source, which is located outside the drum 11 and directs a beam of rays R towards the drum. The rays R are focused by a first optical transmission system, constituted for example by a lens 22 of a kind which is not spherical or in any case has a very limited spherical aberration. In the presence of turns of thread F of the weft reserve RT, the optical system forms, on a generic turn being monitored, a first pointlike image A of the light source 21 and, in the absence of turns, a second pointlike image 3 arranged on a screen surface 23 which is located below the turns and sufficiently spaced from the cylindrical surface on which the turns wind. The surface 23 can be reflective or non-reflective and is constituted by the bottom of a channel-shaped recess 24 provided on the surface of the fixed drum 11 at a radial plane that contains the optical axis of the lens 22. The recess 24 is preferably closed by a plate 25 made of glass (or other transparent material), on which the turns rest. The plate 25 also protects the channel 24 from trapping dust and other foreign objects. The depth p of the channel 24 is preferably chosen so that with respect to the radius r of the drum 11 p/r=0.15–0.45.

By means of a second focused optical projection system, constituted for example by a lens 26 which is also of the non-spherical type, the first or second pointlike luminous images A–B are selectively projected onto corresponding optical sensors 27–28 arranged respectively on a first optical path CO1 and on a second optical path CO2, which have differentiated lengths. The first optical path CO1 joins the first pointlike image A to the sensor 27 and the second optical path C02 joins the second pointlike image B to the sensor 28.

Correspondingly, in the presence of the turns of thread the first image A is projected onto the sensor 27, which emits a turn presence signal "pr", and in the absence of turns the second image B is projected onto the sensor 28, which emits a turn absence signal "as".

An electronic circuit 30, which is operatively connected to the motor 13 by means of an interface 31, processes the signals "pr" and "as" and emits respective signals for stopping and starting the motor 13.

According to a preferred embodiment of the invention, the sensors 27–28 are unified in a single photodiode 40 of the known type termed PSD and manufactured for example by the SHARP company and marketed under the designation PD 311F.

Figure 2:
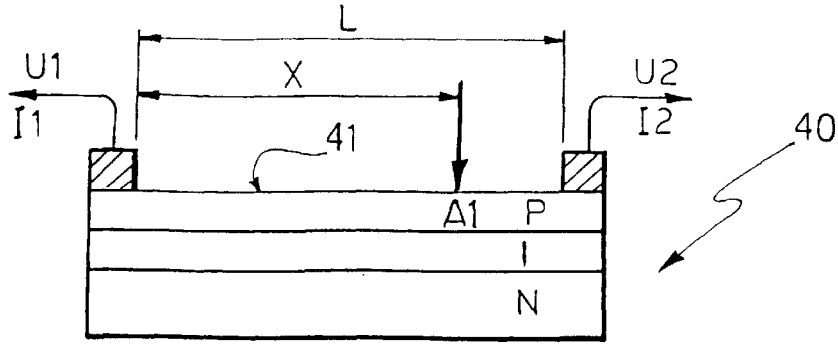
FIGS. 2 and 2*a* are schematic sectional views of the optical receiver of the optical feeler of FIG. 1, according to a first preferred embodiment of the invention.
Figure 2A:
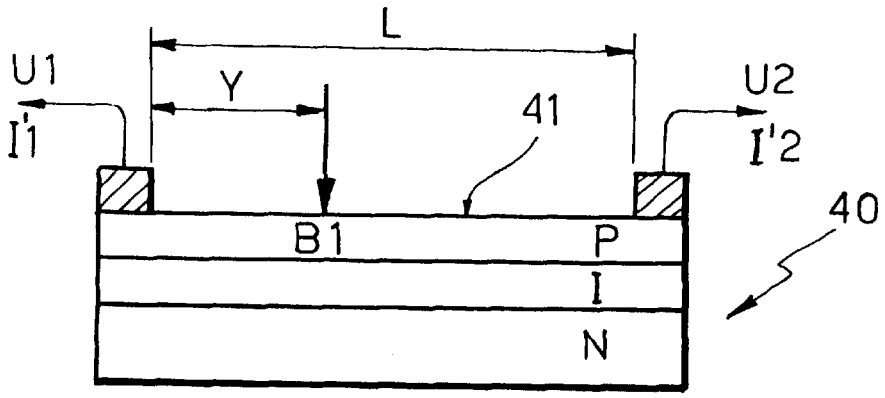

The known photodiode, shown schematically in FIGS. 2 and 2*a*, has two outputs U1–U2 which are affected by current signals I1–I2, the intensities whereof are proportional to the position in which the luminous image is projected onto the active surface 41 of the photodiode.

According to the present invention, the first image A of the light source 21 strikes the active surface 41 of the photodiode 40 in a point A1 (FIG. 2) so that $$I1=L-X/LI$$

$$I2=X/LI$$

where L is the distance between the two outputs U1 and U2 and X is the distance between output U1 and point A1; I is the sum of the currents I1, and I2; and the second image B strikes the surface 41 in a point B1 (FIG. 2*a*) so that $$I'1=L-Y/LI$$

$$I'2=Y/LI$$

where L is the distance between the two outputs U1 and U2 and Y is the distance between output U1 and point B1; I is in this case the sum of the currents I'1 and I'2.

As an alterative to the PSD diode described above, it is possible to use a sensor of the known type termed CCD, or a sensor constituted by an array of photodiodes.

The electronic circuit 30 is programmed to process the pairs of the above cited signals that are simultaneously present and to extract corresponding signals for stopping and starting the motor 13, and to extract a third signal I3=f (I'1–I'2) which is a function of two signals which are simultaneously present and is suitable to provide information related to the operating condition of said screen surface 23 (presence of dust or other substances).

Figure 3:
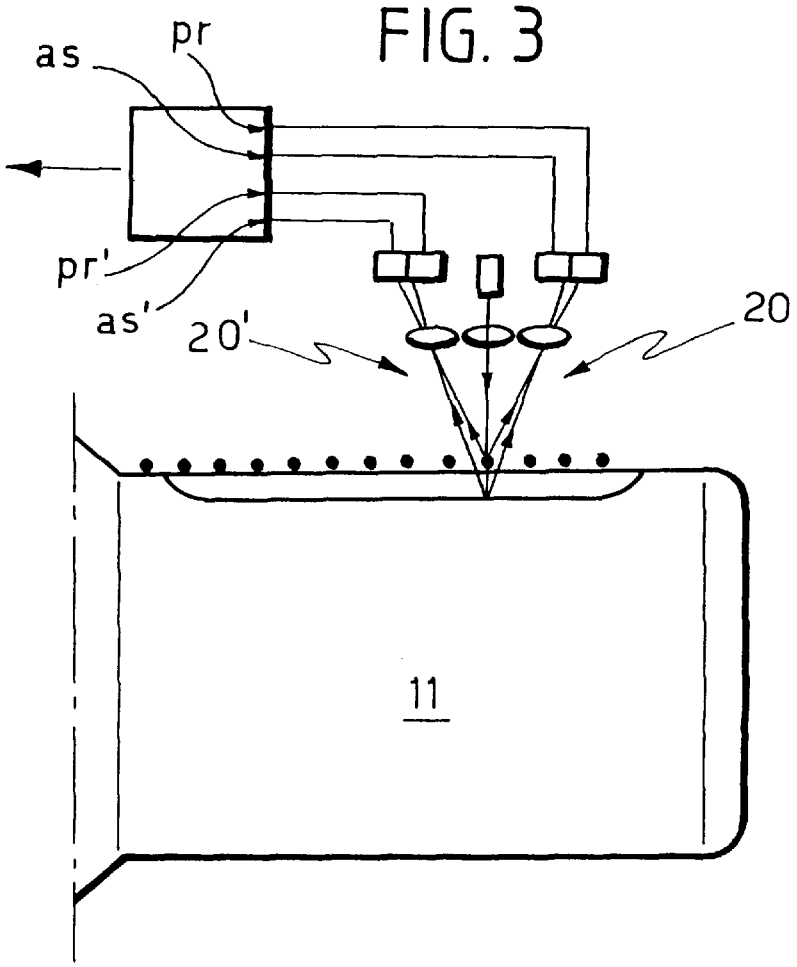
FIG. 3 is a schematic view, similar to FIG. 1, of a second constructive embodiment of the device according to the invention.

The same result is achieved, if the differentiated sensors 27–28 of FIG. 1 are used, with the double arrangement shown in FIG. 3, in which the signals pr-as and pr'-as', which are simultaneously present, allow to obtain a signal I3=f(pr-pr';as-as') for the specified purpose.

Without altering the concept of the invention, the details of execution and the embodiments may of course be altered extensively with respect to what has been described and illustrated by way of non-limitative example without thereby abandoning the scope of the invention.

In particular, the scope of the invention includes also the embodiment that uses an optical feeler (20), as described above, which is arranged on the front part of the feeder 10, downstream of the drum 11, to report the presence or the absence of the turns being unwound; the feeler 20 is arranged, in this case, at the diametrical plane that contains a generatrix of the solid of revolution, i.e., the so-called "balloon", which the unwinding turns generate downstream of the drum.

What is claimed is:

1. An improved optical feeler for monitoring a thread reserve in weft feeders, comprising a light-emitting device constituted by a light source directing light rays onto a thread wound in spaced turns on a drum of the feeder, and a receiver means, which collects the light rays and converts them into electrical signals which indicate presence or absence of turns of thread, the optical feeler further comprising a first focused optical transmission system, which forms a first pointlike luminous image of the light source on the turn being monitored and, in the absence of the turn, a second pointlike luminous image of the light source located on a screen surface which is arranged below the turns, and a second focused optical projection system which selectively projects the first or second luminous image, along respective differentiated optical paths, which have a different length, onto at least one optical sensor capable of emitting discriminated signals which correspond to a discriminated length of the corresponding optical paths that separate the first and second pointlike images from the optical sensor.

2. An optical feeler according to claim 1, wherein said at least one optical sensor comprises a first optical sensor, arranged along a first optical path of said differentiated optical paths that joins the first pointlike image and the first sensor, and a second optical sensor, arranged along a second optical path of said differentiated optical paths that joins the second pointlike image to the second sensor, and in that the first and second sensors are activated selectively and respectively by the first and second images to emit corresponding signals indicating the presence and the absence of the turn.

3. An optical feeler according to claim 1, comprising a single optical sensor with two outputs, the active surface whereof is intersected by both differentiated optical paths, which selectively project the first or second pointlike images in correspondingly discriminated points of the active surface, generating, on said outputs of said single optical sensor, current signals the intensity whereof depends on the position of the discriminated points in relation to the active surface of the sensor.

4. An optical feeler according to claim 3, wherein the single optical sensor is constituted by a PSD diode.

5. An optical feeler according to claim 3, wherein the single sensor is constituted by a CCD sensor.

6. An optical feeler according to claim 3, wherein the single sensor is constituted by an array of photodiodes.

7. An optical feeler according to claim 1, wherein the screen surface is constituted by a bottom of a channel-shaped recess adapted provided on a surface of the drum of the feeder at an optical axis of the first optical system.

8. An optical feeler according to claim 7, wherein the channel-shaped recess is closed by a plate made of transparent material on which the turns of the weft reserve rest.

9. An optical feeler according to claim 1, wherein the first and second optical systems respectively comprise at least one lens of the nonspherical type.

10. An optical feeler according to claim 1, wherein the screen surface is opaque.

11. An optical feeler according to claim 1, wherein the screen surface is reflective.

12. An optical feeler according to claim 1, further comprising an electronic circuit for connection to a motor of the feeder for processing the discriminated signals emitted by the optical sensors and to emit corresponding signals for starting and stopping the motor.

13. An optical feeler according to claim 1, further comprising a double arrangement of the first and second optical systems.

14. A combination of a weft feeder and an optical feeler wherein the optical feeler comprises a light-emitting device constituted by a light source which directs light rays onto a thread wound in spaced turns on a drum of the feeder, and a receiver means, which collects the light rays and converts them into electrical signals which indicate presence or absence of turns of thread, the optical feeler further comprising a first focused optical transmission system, which forms a first pointlike luminous image of the light source on the turn being monitored and, in the absence of the turn, a second pointlike luminous image of the light source located on a screen surface which is arranged below the turns, and a second focused optical projection system which selectively projects the first or second luminous image, along respective differentiated optical paths, which have a different length, onto at least one optical sensor capable of emitting discriminated signals which correspond to a discriminated length of the corresponding optical paths that separate the first and second pointlike images from the optical sensor.

15. The combination according to claim 14, wherein the optical feeler is arranged at the drum of the feeder and monitors the weft reserve accumulated on the drum.

16. The combination according to claim 14, wherein the optical feeler is arranged on the front part of the feeder, downstream of the drum of the feeder, and at a generatrix of a balloon formed by the unwinding turns, in order to indicate the presence or absence of the turns being unwound.

* * * * *